US006561149B1

(12) United States Patent
Kobayashi et al.

(10) Patent No.: US 6,561,149 B1
(45) Date of Patent: May 13, 2003

(54) ROTARY PHASE CONTROLLER, AND VALVE TIMING CONTROLLER OF INTERNAL COMBUSTION ENGINE

(75) Inventors: Yoshiyuki Kobayashi, Kanagawa (JP); Shigeaki Yamamuro, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 10/160,123

(22) Filed: Jun. 4, 2002

(30) Foreign Application Priority Data

Jun. 19, 2001 (JP) ..... 2001-184301
Oct. 22, 2001 (JP) ..... 2001-323941

(51) Int. Cl.[7] ..... F01L 1/34

(52) U.S. Cl. ..... 123/90.17; 123/90.11; 123/90.15; 123/90.16; 123/90.27; 123/90.31; 251/129.01; 464/29

(58) Field of Search ..... 123/90.11, 90.15, 123/90.16, 90.17, 90.27, 90.31; 251/129.01, 129.16, 129.15; 464/1, 2, 160, 29; 74/568 R

(56) References Cited

U.S. PATENT DOCUMENTS 4,754,727 A * 7/1988 Hampton ..... 123/90.15
5,067,450 A * 11/1991 Kano et al. ..... 123/90.17
5,394,131 A * 2/1995 Lungu ..... 335/229
5,518,092 A * 5/1996 Ma ..... 192/41 R
5,785,018 A * 7/1998 Schebitz ..... 123/90.17
6,359,360 B1 * 3/2002 Lungu ..... 310/168

FOREIGN PATENT DOCUMENTS

JP 56143816 A * 11/1981 ..... F16D/67/06
JP 3-50308 3/1991
JP P2001-41013 2/2001

OTHER PUBLICATIONS

Bergstrom et al., Flat Lamination Solenoid, U.S. Patent Application Pub. No. 2001/0030307 A1, Oct. 18, 2001.*

* cited by examiner

*Primary Examiner*—Thomas Denion
*Assistant Examiner*—Ching Chang
(74) *Attorney, Agent, or Firm*—Foley & Lardner

(57) ABSTRACT

A rotary phase controller includes: a permanent magnet block, a yoke block, and an electromagnetic coil block. The permanent magnet block has a constitution where different magnetic pole surfaces are alternately arranged. The yoke block includes yokes. The yoke includes: a first pole tooth ring formed with first pole teeth opposing the magnetic pole surfaces, and a second pole tooth ring formed with second pole teeth opposing the magnetic pole surfaces. The first pole teeth and the second pole teeth are alternately disposed. The first pole teeth of the first yoke are shifted by a predetermined pitch circumferentially from the second pole teeth of the second yoke. The electromagnetic coil block includes electromagnetic coils. A first electromagnetic coil and a second electromagnetic coil have a magnetic input-output end opposing, via air gap, the first pole tooth ring and the second pole tooth ring of the first yoke and second yoke.

15 Claims, 12 Drawing Sheets

ROTARY PHASE CONTROLLER, AND VALVE TIMING CONTROLLER OF INTERNAL COMBUSTION ENGINE

BACKGROUND OF THE INVENTION

1. Field of the Invention

The present invention relates to a rotary phase controller for varying rotary phase of a drive side and a follower side.

The present invention also relates to a valve timing controller for controlling timing of the internal combustion engine, by varying the rotary phase of the drive side and the follower side.

2. Description of the Related Art

A valve timing controller of an internal combustion engine varies a rotary phase between a drive rotor (which is connected to a crank shaft by way of a timing chain and the like) and a follower rotor (which is connected to a cam shaft side) through revolutionary operation relative to each other, to thereby control open-close timing of the internal combustion engine.

A rotary phase controller such as the valve timing controller described above generally uses fluid pressure. The rotary phase controller using the fluid pressure can assuredly control the rotary phase. The rotary phase controller using the fluid pressure, however, has complicated piping, which is responsible for its likeliness of becoming large in size. In addition, the rotary phase controller using the fluid pressure may have low responsiveness until sufficient fluid pressure is obtained.

Moreover, the following rotary phase controller is devised:

An electric motor gear incorporated between the drive rotor and the follower rotor is rotated so as to revolve the drive rotor relative to the follower rotor when so requested.

The above electric motor gear rotary phase controller can eliminate shortcomings which is caused when using the fluid pressure. The electric motor gear rotary phase gear, however, uses a slip ring and the like which constantly causes an impingement during rotation, and therefore, is low in durability.

Japanese Patent Unexamined Publication No. Heisei 3(1991)-050308 describes a rotary phase controller for varying rotary phase of the drive rotor and the follower rotor by means of a magnetic force (of an electromagnetic coil fixed to an irrotational member) and a spring member.

BRIEF SUMMARY OF THE INVENTION

It is an object of the present invention to provide a rotary phase controller and a valve timing controller (for an internal combustion engine) featuring high durability as well as operation accuracy, by securing a drive rotor and a follower rotor at an arbitrary revolutionary position relative to each other.

According to a first aspect of the present invention, there is provided a rotary phase controller varying rotary phase of a drive rotor and a follower rotor through a relative rotary operation between the drive rotor which is rotatably driven and the follower rotor which receives a power from the drive rotor. The rotary phase controller comprises: a permanent magnet block), a yoke block, and an electromagnetic coil block. The permanent magnet block is disposed on one of the drive rotor's side and the follower rotor's side. The permanent magnet block has a constitution in which different magnetic pole surfaces of a permanent magnet are alternately arranged circumferentially. The yoke block is disposed as a whole on the other of the drive rotor's side and the follower rotor's side. The yoke block includes a plurality of yokes including a first yoke and a second yoke. Each of the plurality of the yokes includes: a first pole tooth ring formed with a plurality of first pole teeth which oppose the magnetic pole surfaces of the permanent magnet block, and a second pole tooth ring formed with a plurality of second pole teeth which oppose the magnetic pole surfaces of the permanent magnet block. The first pole teeth and the second pole teeth are alternately disposed circumferentially. The first yoke and the second yoke are assembled such that the first pole teeth of the first yoke are shifted by a predetermined pitch circumferentially from the second pole teeth of the second yoke. The electromagnetic coil block is fixed to an irrotational member. The electromagnetic coil block includes a plurality of electromagnetic coils including a first electromagnetic coil and a second electromagnetic coil corresponding respectively to the first yoke and the second yoke of the yoke block. Each of the first electromagnetic coil and the second electromagnetic coil has a magnetic input-output end opposing, by way of an air gap, the first pole tooth ring and the second pole tooth ring of the respective first yoke and second yoke. The yoke block and the permanent magnet block make a revolution relative to each other by varying at a predetermined pattern a magnetic field which is generated at the plurality of the electromagnetic coils.

According to a second aspect of the present invention, there is provided a valve timing controller of an internal combustion engine varying rotary phase of a crank shaft and a cam shaft through a relative rotary operation between a drive rotor which is driven by the crank shaft and a follower rotor which is one of the cam shaft and a member coupled to the cam shaft. The valve timing controller comprises: a permanent magnet block), a yoke block, and an electromagnetic coil block. The permanent magnet block is disposed on one of the drive rotor's side and the follower rotor's side. The permanent magnet block has a constitution in which different magnetic pole surfaces of a permanent magnet are alternately arranged circumferentially. The yoke block is disposed as a whole on the other of the drive rotor's side and the follower rotor's side. The yoke block includes a plurality of yokes including a first yoke and a second yoke. Each of the plurality of the yokes includes: a first pole tooth ring formed with a plurality of first pole teeth which oppose the magnetic pole surfaces of the permanent magnet block, and a second pole tooth ring formed with a plurality of second pole teeth which oppose the magnetic pole surfaces of the permanent magnet block. The first pole teeth and the second pole teeth are alternately disposed circumferentially. The first yoke and the second yoke are assembled such that the first pole teeth of the first yoke are shifted by a predetermined pitch circumferentially from the second pole teeth of the second yoke. The electromagnetic coil block is fixed to an irrotational member. The electromagnetic coil block includes a plurality of electromagnetic coils including a first electromagnetic coil and a second electromagnetic coil corresponding respectively to the first yoke and the second yoke of the yoke block. Each of the first electromagnetic coil and the second electromagnetic coil has a magnetic input-output end opposing, by way of an air gap, the first pole tooth ring and the second pole tooth ring of the respective first yoke and second yoke. The yoke block and the permanent magnet block make a revolution relative to each other by varying at a predetermined pattern a magnetic field which is generated at the plurality of the electromagnetic coils.

The other objects and features of the present invention will become understood from the following description with reference to the accompanying drawings.

Figure 13B:
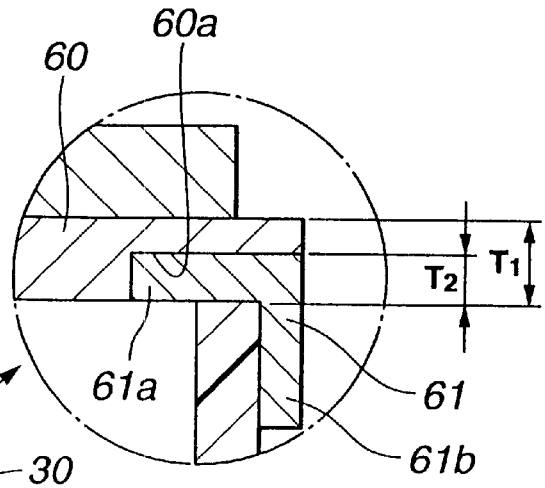
Figure 13A:
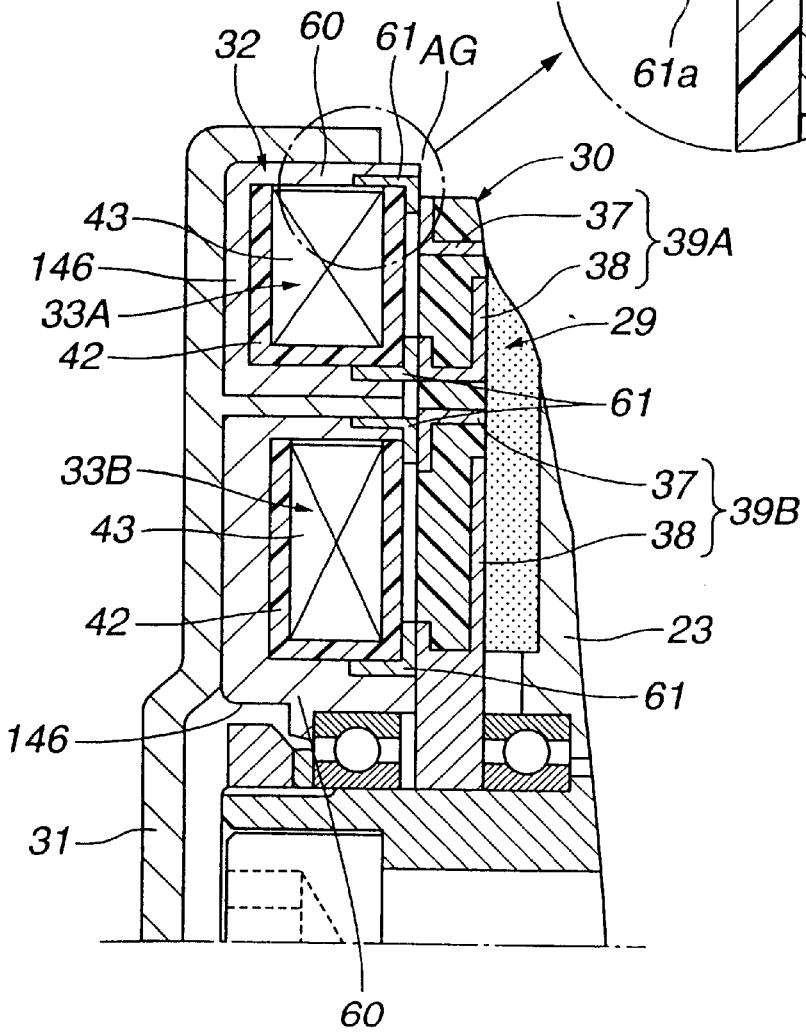
Figure 14:
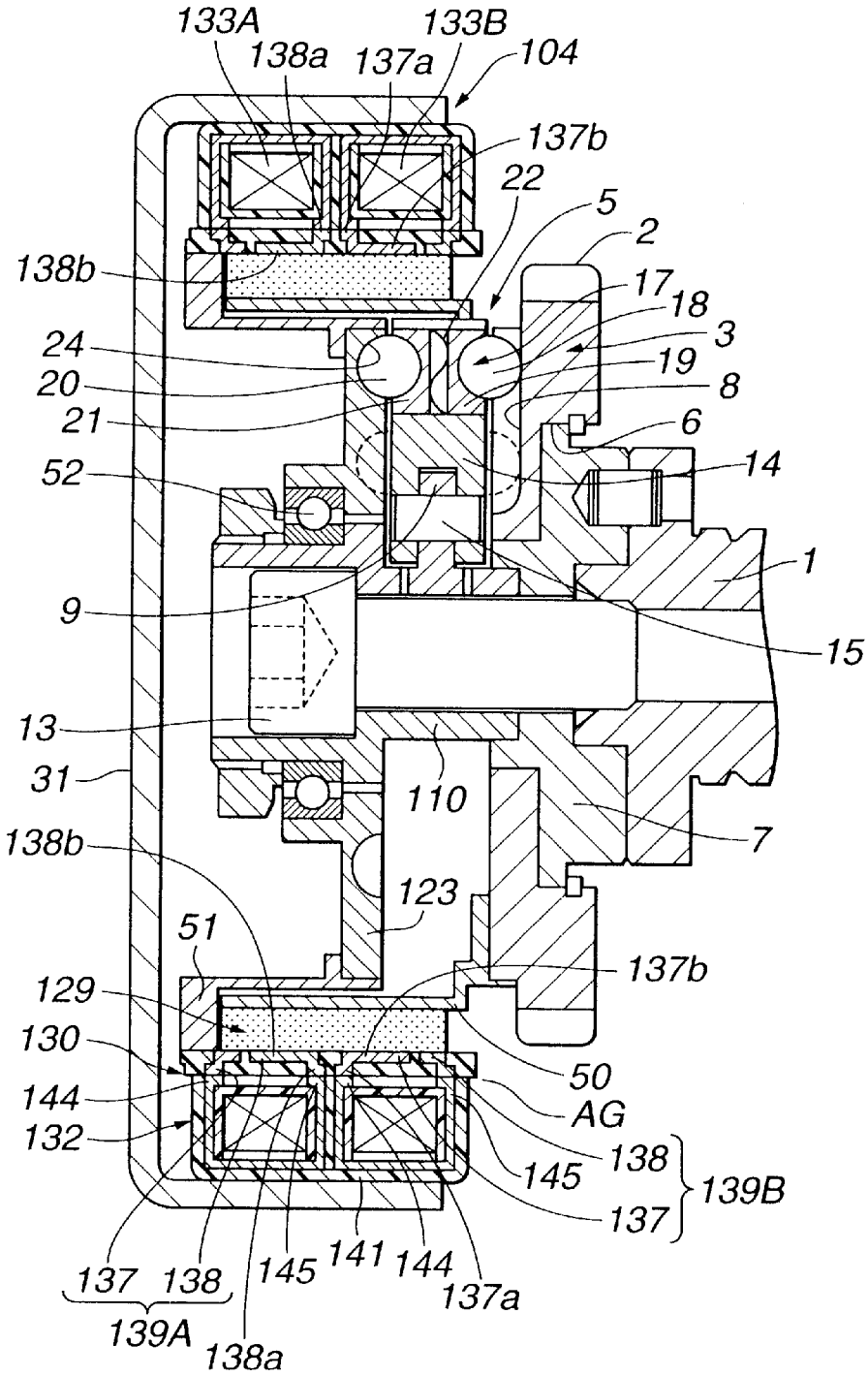
Figure 15:
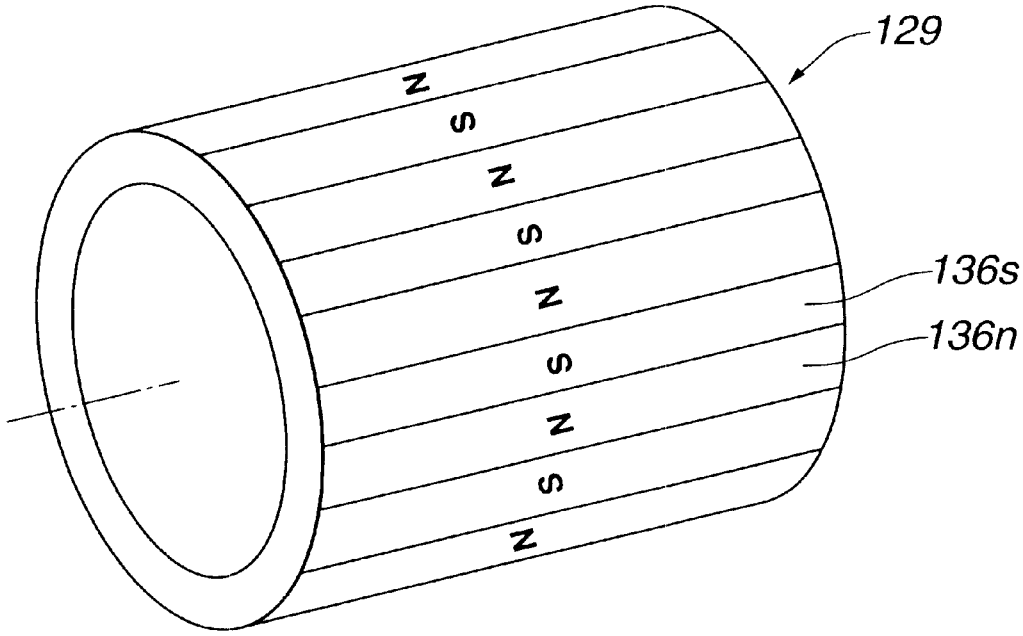

directions of magnetic field and excitation current (of each of a first electromagnetic coil 33A and a second electromagnetic coil 33B), and shown schematically on the right side include:

magnetic poles of each of a first yoke 39A and a second yoke 39B corresponding to one of the operation step 1 to operation step 4, and the north-pole magnetic surface 36*n* of the permanent magnet block 29;

FIGS. 13A and 13B are views of a part of the longitudinal cross section of the rotary phase controller, according to a second embodiment of the present invention;

FIG. 14 is a view of the longitudinal cross section of the rotary phase controller, according to a third embodiment of the present invention; and FIG. 15 is a perspective view of a permanent magnet block 129, according to the third embodiment.

DETAILED DESCRIPTION OF THE EMBODIMENTS

In the following, various embodiments of the present invention will be described in detail with reference to the accompanying drawings.

For ease of understanding, the following description will contain various directional terms, such as, left, right, upper, lower and the like. However, such terms are to be understood with respect to only a drawing or drawings on which the corresponding part of element is illustrated.

As is seen in FIG. 1 to FIG. 12, there is provided a rotary phase controller, according to a first embodiment of the present invention.

As a valve timing controller, the rotary phase controller according to the first embodiment can be applied to a power transmission system on an intake side of an internal combustion engine. Likewise, the rotary phase controller according to the first embodiment can be applied to a power transmission system on an exhaust side of the internal combustion engine.

Figure 1B:
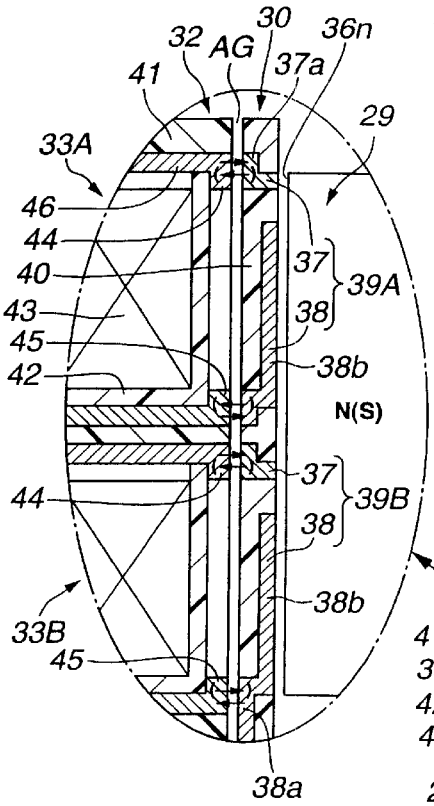
FIGS. 1A and 1B (also referred to collectively as FIG. 1) are views of a longitudinal cross section of a rotary phase controller (valve timing controller), according to a first embodiment of the present invention.
Figure 1A:
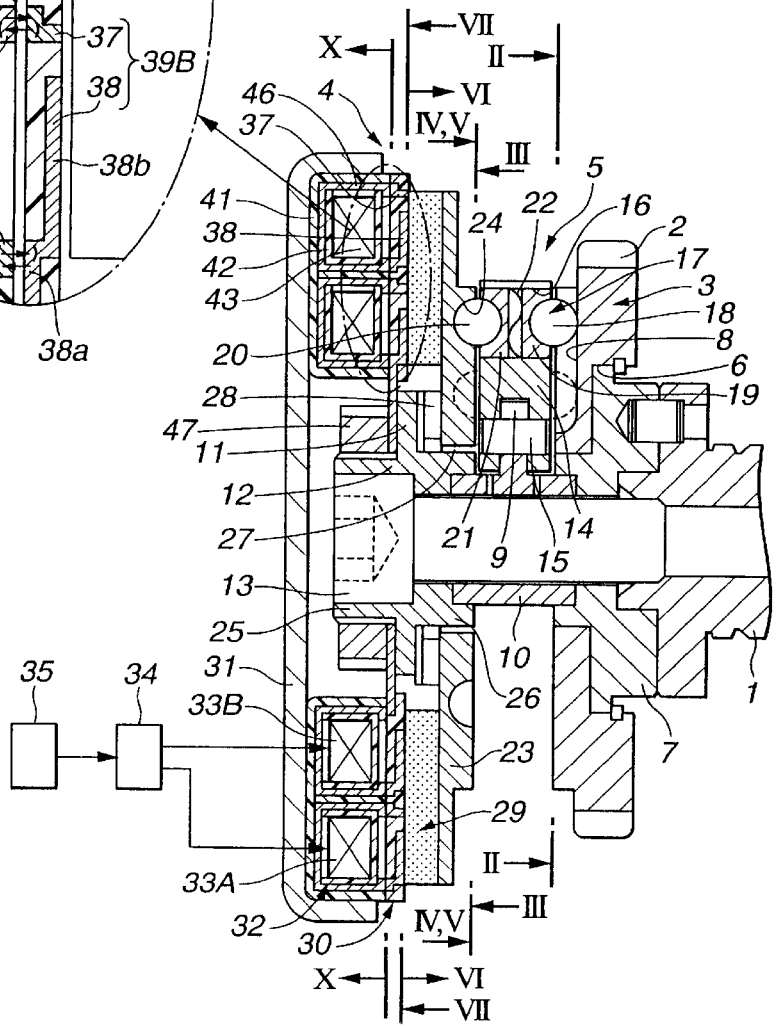

As is seen in FIGS. 1A and 1B (also referred to collectively as FIG. 1), the valve timing controller is constituted of a cam shaft 1, a drive plate 3, a rotary force generator 4, and a torque amplifier 5. Cam shaft 1 (otherwise referred to as "follower rotor") is rotatably supported to a cylinder head (not shown) of the internal combustion engine. Drive plate 3 (otherwise referred to as "drive rotor") is mounted to a front end (left in FIG. 1) of cam shaft 1 in such as manner as to revolve relative to cam shaft 1 when so requested. Drive plate 3 has an outer periphery which is formed with a timing sprocket 2 communicating to a crank shaft (not shown). Rotary force generator 4 is disposed on a front side (left in FIG. 1) of drive plate 3 and cam shaft 1. Rotary force generator 4 can generate a rotary force for allowing drive plate 3 and cam shaft 1 to cause a revolution relative to each other. Torque amplifier 5 can amplify the rotary force generated with rotary force generator 4, so as to directly rotate drive plate 3 and cam shaft 1 with the thus amplified rotary force.

Figure 2:
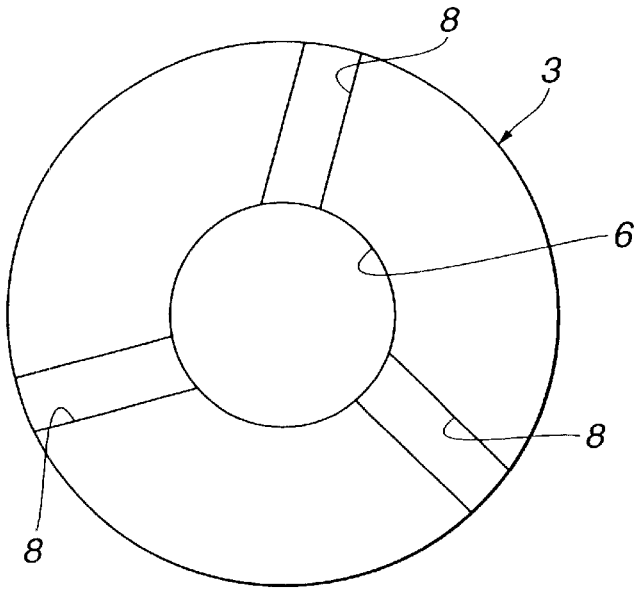
FIG. 2 is a view of an end face taken along the lines II—II in FIG. 1, according to the first embodiment.

As is seen in FIG. 2, drive plate 3 is shaped substantially into a disk having a center section formed with a support hole 6 which is stepwise (see FIG. 1). An inner wall of support hole 6 is rotatably supported with a flange ring 7 which is integrally coupled to the front end of cam shaft 1. Drive plate 3 has a front face (opposite to a face facing cam shaft 1) which is formed with three radial slots 8 (otherwise, referred to as "radial guides") extending substantially radially, as is seen in FIG. 2. Radial slot 8 has a cross section which is substantially semicircular.

Figure 4:
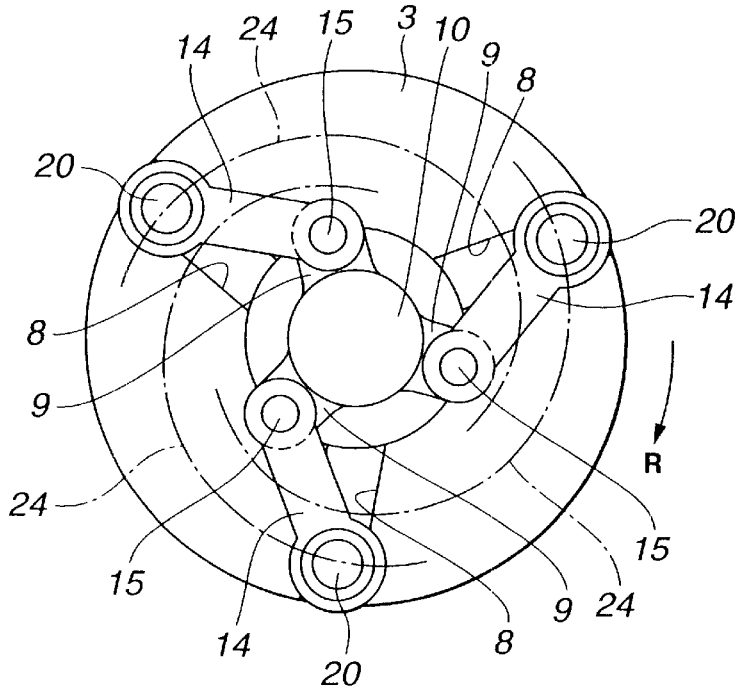
FIG. 4 is a view of an end face taken along the lines IV—IV in FIG. 1, according to the first embodiment.
Figure 5:
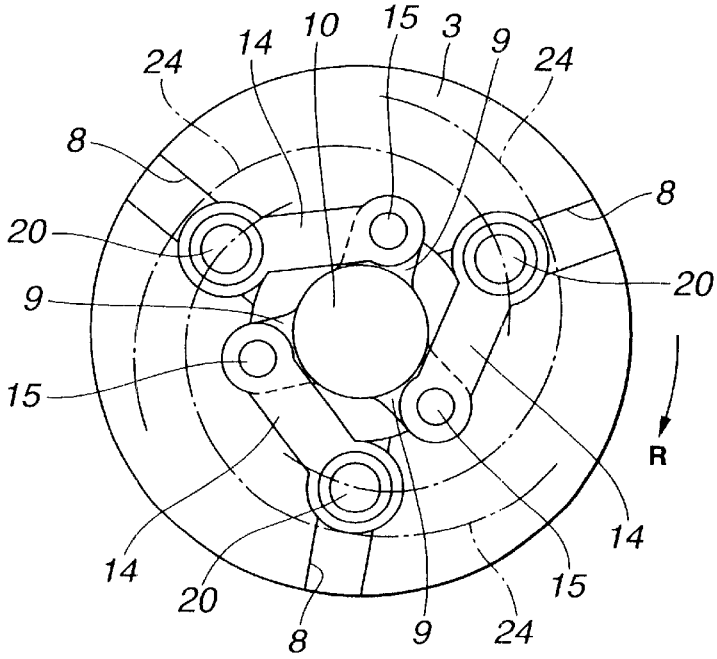
FIG. 5 is similar to FIG. 4 but showing an end face taken along the lines V—V in FIG. 1, for showing operation of the rotary phase controller, according to the first embodiment.

As is seen in FIGS. 1, 4 and 5, there are provided a lever shaft 10 and a hold ring 12 overlapping with lever shaft 10. Lever shaft 10 has three levers 9 protruding radially outward. Hold ring 12 has a support flange 11. Together with flange ring 7, lever shaft 10 and hold ring 12 are coupled to cam shaft 1 by means of a bolt 13. As is seen in FIGS. 4 and 5, there is also provided a link 14 having a first end which is pivotally supported, by way of a pin 15, to each of three levers 9 of lever shaft 10. Link 14 has a second end which is formed with a receptacle hole 16 (through hole) extending axially. A movable member 17 is received in receptacle hole 16.

As is seen in FIG. 1, movable member 17 is constituted of a first retainer 19, a second retainer 21, and a plate spring 22 (wave form). On a first side facing drive plate 3, first retainer 19 retains a first ball 18. On the other hand, on a second side opposite to the first side, first retainer 19 retains a second ball 20. Plate spring 22 is disposed between first retainer 19 and second retainer 21, so as to bias first retainer 19 and second retainer 21 opposite to each other.

Together with plate spring 22, first retainer 19 and second retainer 21 are received in receptacle hole 16 of link 14. Each of first retainer 19 and second retainer 21 is shaped substantially into a thick disk. A front side (right in FIG. 1) of first retainer 19 has a center section which is formed with a semispherical depression retaining first ball 18, while a front side (left in FIG. 1) of second retainer 21 has a center section which is formed with a semispherical depression retaining second ball 20. Thus, first ball 18 and second ball 20 retained respectively with first retainer 19 and second retainer 21 are coaxially disposed at the second end of link 14. At the second end of link 14, first ball 18 and second ball 20 protrude axially opposite to each other.

Figure 3:
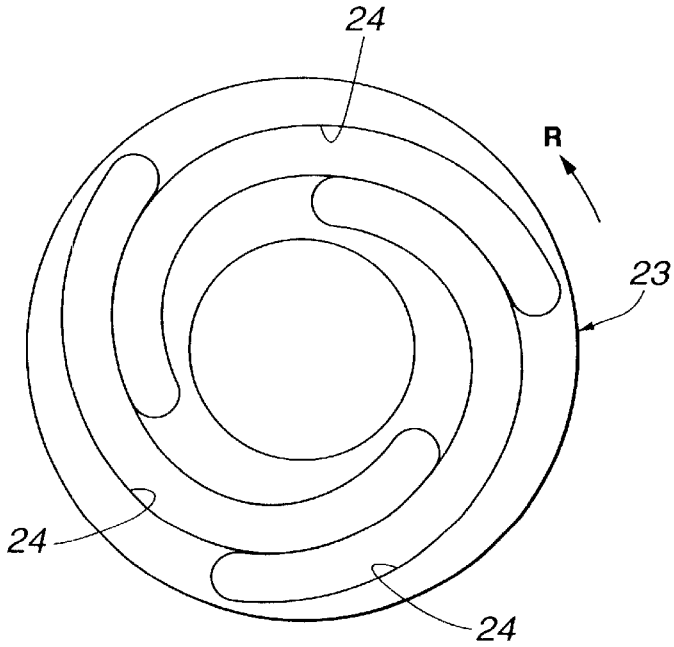
FIG. 3 is a view of an end face taken along the lines III—III in FIG. 1, according to the first embodiment.

First ball 18 retained with first retainer 19 engages with radial slot 8 of drive plate 3 in such a manner as to roll. Likewise, second ball 20 retained with second retainer 21 engages with a spiral slot 24 (otherwise, referred to as "spiral guide") in such a manner as to roll, as is seen in FIGS. 1 and 3. Spiral slot 24 is formed in a middle rotor 23 (to be described afterward), and has a cross section substantially semicircular.

Being guided radially along radial slot 8 of drive plate 3, movable member 17 is connected to cam shaft 1 by way of link 14 and lever 9. When an external force is applied to movable member 17 from middle rotor 23's side and thereby displacing movable member 17 along radial slot 8, the above connection of movable member 17 to cam shaft 1 may contribute to the following operation:

A link operation attributable to link 14 and lever 9 will cause revolution between drive plate 3 and cam shaft 1 relative to each other, in a direction and by an angle corresponding to the displacement of movable member 17.

On the other hand, support flange 11 of hold ring 12 is formed with a first boss section 25 disposed axially forward (leftward in FIG. 1) and a second boss section 26 disposed axially backward (rightward in FIG. 1). Around second boss section 26, there is disposed middle rotor 23 which is shaped substantially into a disk. Middle rotor 23 is formed with a play hole 27 whose inner wall is larger in diameter than second boss section 26, to thereby causing no contact with second boss section 26. Moreover, middle rotor 23 has a back face (drive plate 3's side) which is formed with three spiral slots 24 each of which corresponds to one of movable members 17.

As is seen in FIGS. 3 to 5, each of spiral slots 24 is so formed as to gradually decrease in diameter in a rotational direction R of drive plate 3 (FIGS. 4 and 5 show only a center line of each of spiral slots 24). The gradual decrease in diameter of spiral slots 24 can contribute to the following operation:

When middle rotor 23 rotates in a lagging direction relative to drive plate 3 with second ball 20 (of movable member 17) engaging with spiral slot 24, the movable plate 17 may move radially inward along spiral slot 24. Contrary to the above, when middle rotor 23 revolves in a leading direction relative to drive plate 3 with second ball 20 (of movable member 17) engaging with spiral slot 24, the movable plate 17 may move radially outward along spiral slot 24.

Between support flange 11 (of hold ring 12) and an inner periphery (of middle rotor 23), there is provided a thrust bearing 28 which is shaped substantially into a needle. Middle rotor 23 is rotatably supported to hold ring 12 by way of thrust bearing 28.

According to the first embodiment, torque amplifier 5 is constituted of radial slot 8 (of drive plate 3), movable member 17, link 14, lever 9, spiral slot 24 (of middle rotor 23), and the like. With a rotary force (relative to cam shaft 1) applied to middle rotor 23 from rotary force generator 4, torque amplifier 5 can displace movable member 17 radially by way of spiral slot 24. Moreover, by way of radial slot 8, link 14 and lever 9, torque amplifier 5 can amplify the rotary force by a multiplying factor, to thereby apply a relative rotary force to drive plate 3 and cam shaft 1.

On the other hand, rotary force generator 4 is constituted of a permanent magnet block 29, a yoke block 30, and an electromagnetic coil block 32. Permanent magnet block 29 is shaped substantially into an annular plate which is joined to an outer periphery on a front side (left in FIG. 1, and opposite to drive plate 3) of middle rotor 23. Yoke block 30 is shaped substantially into a thin annular plate which is flanged radially outward from hold ring 12. Electromagnetic coil block 32 is fixed in a valve timing control cover 31 (an irrotational member) which is so mounted as to stride over the cylinder head (not shown) and a rocker cover (not shown). A first electromagnetic coil 33A and a second electromagnetic coil 33B constituting electromagnetic coil block 32 are connected to a drive circuit 34 which includes an excitation circuit, a pulse distributor circuit, and the like. A controller 35 can control drive circuit 34. Controller 35 can receive various input signals such as crank angle, cam angle, engine speed, engine load and the like, to thereby output control signals to drive circuit 34 in accordance with operating states of the internal combustion engine.

Figure 6:
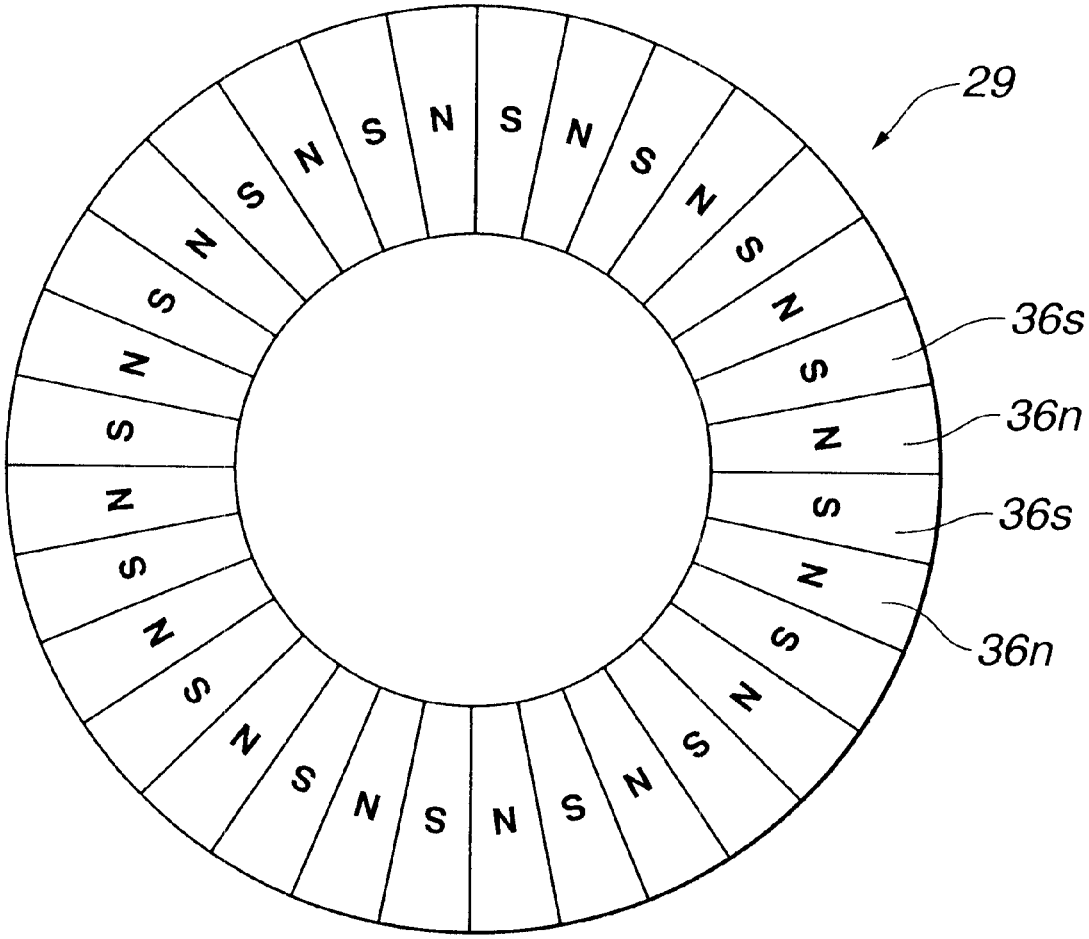
FIG. 6 is a view of an end face taken along the lines VI—VI in FIG. 1, according to the first embodiment.

As is seen in FIG. 6, permanent magnet block 29 defines a surface (orthogonal to the axis) which is formed with a plurality of magnetic poles (N-pole and S-pole) extending radially. The N-poles and the S-poles are alternately arranged circumferentially. In FIG. 6, a north-pole magnetic surface 36*n* signifies the N-pole, while a south-pole magnetic surface 36*s* signifies the S-pole.

As is seen in an enlarged part of FIG. 1, yoke block 30 is constituted of a pair of a first yoke 39A and a second yoke 39B (to be described afterward). Each of first yoke 39A and second yoke 39B has a pair of a first pole tooth ring 37 and a second tooth ring 38. Yoke block 30 has an inner periphery which is securely disposed between a support flange 11 (of hold ring 12) and a nut 47, where the nut 47 is screwed down on first boss section 25 on the front side of hold ring 12.

Figure 7:
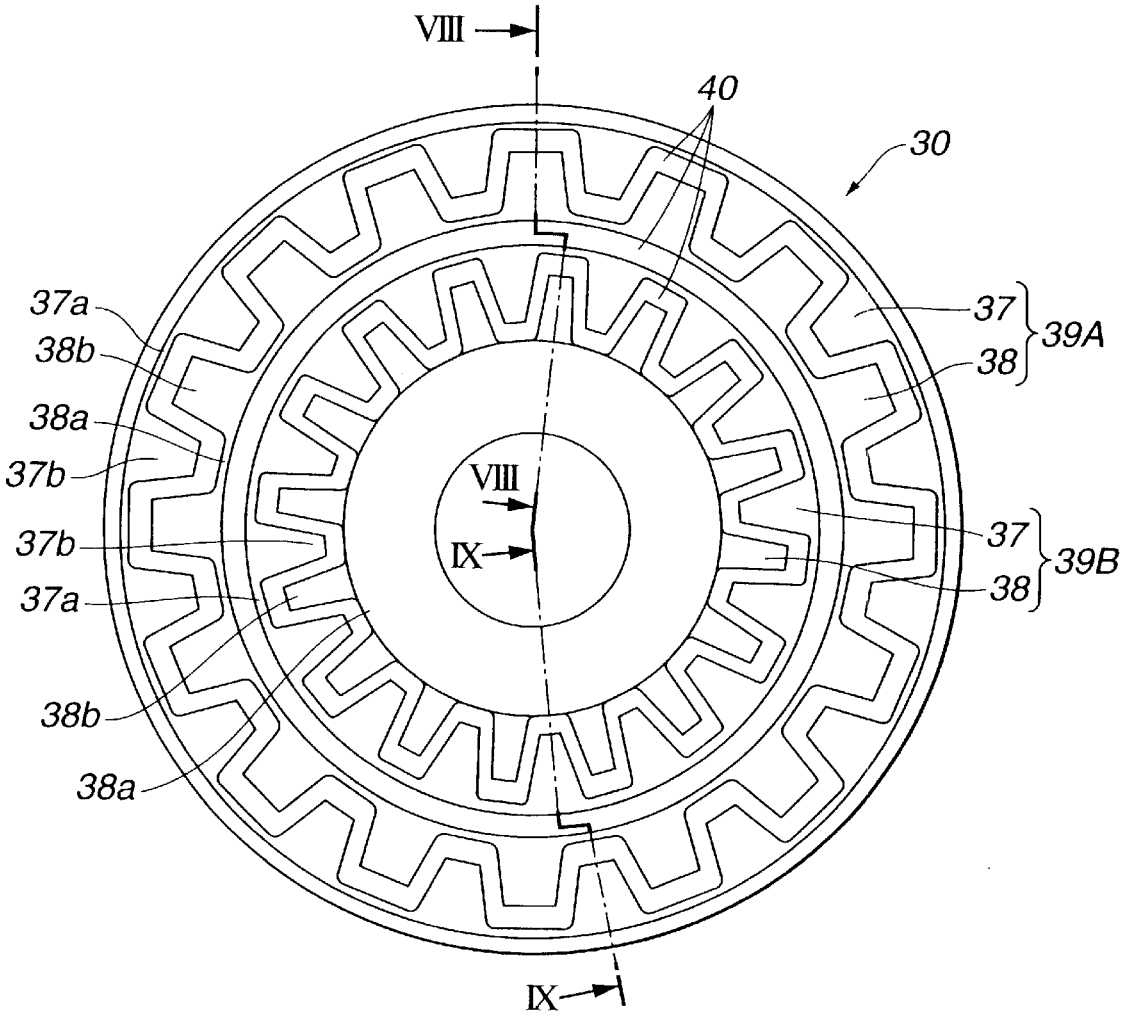
FIG. 7 is a view of an end face taken along the lines VII—VII in FIG. 1, according to the first embodiment.

First pole tooth ring 37 and second pole tooth ring 38 of each of first yoke 39A and second yoke 39B are made of metal material having high permeability. As is seen in FIG. 7, First pole tooth ring 37 and second pole tooth ring 38 have, respectively, a first base section 37*a* and a second base section 38*a*, each of which is shaped substantially into a flat ring. Moreover, first pole tooth ring 37 and second pole tooth ring 38 have, respectively, a plurality of first pole teeth 37*b* and a plurality of second pole teeth 38*b*, each of which is shaped substantially into a trapezium. First pole teeth 37*b* extend radially inward, while second pole teeth 38*b* extend radially outward.

According to the first embodiment, first pole tooth ring 37 is disposed radially outward, while second pole tooth ring 38 is disposed radially inward. First pole teeth 37*b* (of first pole tooth ring 37) and second pole teeth 38*b* (of second pole tooth ring 38) are disposed at regular angular intervals circumferentially. In addition, First pole teeth 37*b* have addenda directing toward second base section 38*a*, while second pole teeth 38*b* have addenda directing toward first base section 37*a*. In other words, the addenda of first pole teeth 37*b* extend radially inward, while the addenda of second pole teeth 38*b* extend radially outward. First pole teeth 37*b* (of first pole tooth ring 37) and second pole teeth 38*b* (of second pole tooth ring 38) are disposed alternately circumferentially in such a manner as to define equidistant pitches. First pole tooth ring 37 and second pole tooth ring 38 are coupled to each other by way of a resin material 40 (insulator).

First yoke 39A and second yoke 39B constitute yoke block 30. First yoke 39A is disposed radially outside, while second yoke 39B is disposed radially inside. First yoke 39A and second yoke 39B are so arranged as to form an entire configuration shaped substantially into a disk.

Figure 12:
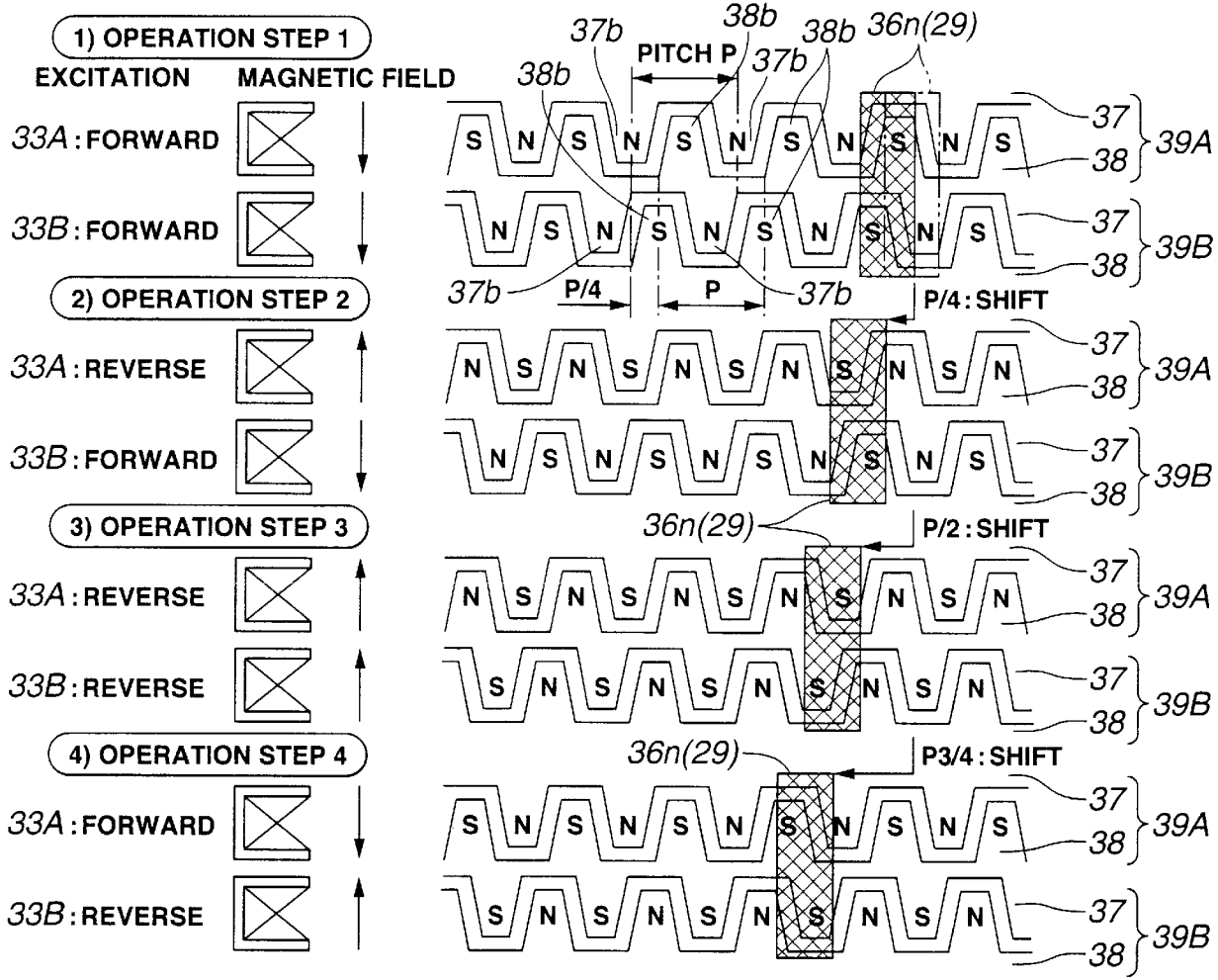
FIG. 12 is a view of an excitation sequence, according to the first embodiment, in which shown on the left side are operation step 1 to operation step 4 include.

As is seen in FIG. 12 (excitation sequence), first yoke 39A and second yoke 39B are mounted such that first pole teeth 37*b* and second pole teeth 38*b* are shifted by ¼ pitches circumferentially.

Hereinabove, one pitch is defined as a distance between adjacent two of first pole teeth 37*b* (or second pole teeth 38*b*) on first pole tooth ring 37 (or second pole tooth ring 38).

Otherwise, the one pitch may be defined in the following manner:

The one pitch is a distance between first pole tooth 37*b* (on first pole tooth ring 37) and second pole tooth 38*b* (on second pole tooth ring 38) adjacent to each other. In this case, first pole teeth 37*b* and second pole teeth 38*b* can be interpreted as being shifted by ½ pitches circumferentially.

As is seen in FIG. 1, yoke block 30 has a first side (left in FIG. 1) axially facing electromagnetic coil block 32 and a second face (right in FIG. 1) axially facing permanent magnet block 29.

Figure 8:
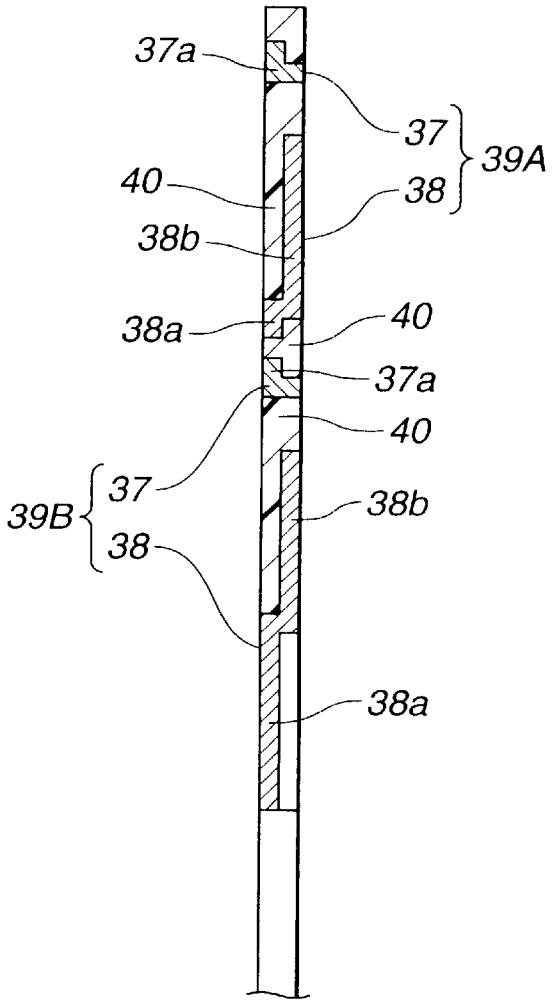
FIG. 8 is a view of a cross section taken along the lines VIII—VIII in FIG. 7, according to the first embodiment.
Figure 9:
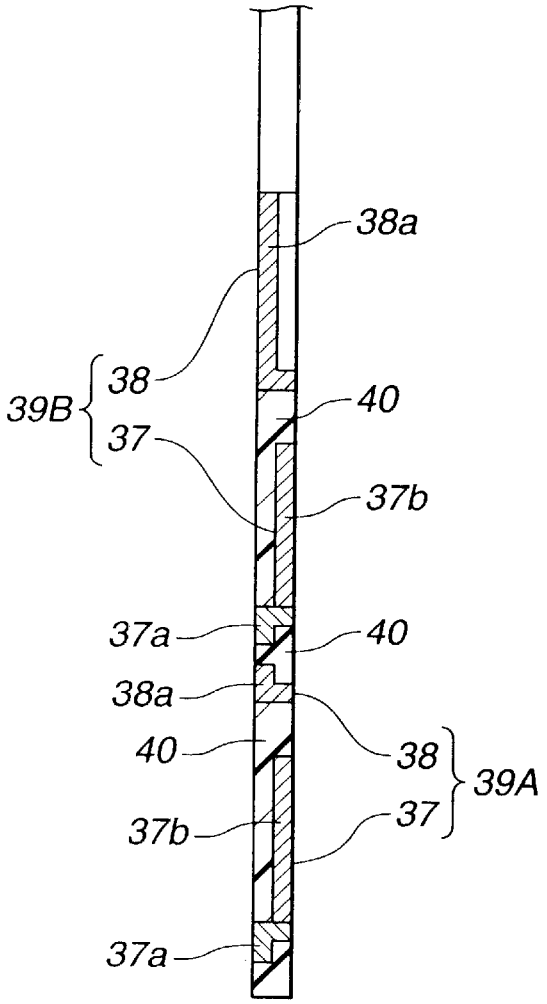
FIG. 9 is a view of a cross section taken along the lines IX—IX in FIG. 7, according to the first embodiment.

As is seen in FIGS. 8 and 9, first base section 37*a* (of first pole tooth ring 37) and second base section 38*a* (of second pole tooth ring 38) of each of first yoke 39A and second yoke 39B are disposed on a side (left in FIGS. 8 and 9) facing electromagnetic coil block 32. Moreover, as is seen in FIGS. 8 and 9, first pole tooth 37*b* and second pole tooth 38*b* of each of first yoke 39A and second yoke 39B are disposed on a side (right in FIGS. 8 and 9) facing permanent magnet block 29.

For allowing disposition described above, a connection is bent between first pole tooth 37*b* and first base section 37*a* (FIG. 9), while a connection is bent between second pole tooth 38*b* and second base section 38*a* (FIG. 8). Like first pole tooth ring 37 and second pole tooth ring 38, first yoke 39A (of yoke block 30) and second yoke 39B (of yoke block 30) are coupled to each other by way of resin material 40 (insulator).

Thus, all first pole tooth rings 37 and second pole tooth rings 38 adjacent to each other can be firmly joined to resin material 40 by a large area including side faces of first base section 37*a* and second base section 38*a*, and side faces of first pole teeth 37*b* and second pole teeth 38*b*. In addition, first base section 37*a* (of first pole tooth ring 37) and second base section 38*a* (of second pole tooth ring 38) can be so disposed as to be close enough to electromagnetic coil block 32, while first pole teeth 37*b* and second pole teeth 38*b* can be so disposed as to be close enough to permanent magnet block 29. Resin material 40 (insulator) is filled between all of first pole tooth rings 37 and second pole tooth rings 38 of yoke block 30, to thereby prevent any unnecessary magnetic flux leak from between first pole tooth ring 37 and second pole tooth ring 38 adjacent to each other. Moreover, resin material 40 can prevent any eddy current which may be caused by rotation of yoke block 30.

Yoke block 30 can be molded for example in the following operations (preferable):

1. Dispose first pole tooth ring 37 and second pole tooth ring 38 of each of first yoke 39A and second yoke 39B in a mold in a predetermined manner.
2. Flow resin material 40 into the mold, so as to fill an area between first pole tooth ring 37 and second pole tooth ring 38 with resin material 40.

Molding yoke block 30 in the above operations is accurate and can facilitate assembly of all first pole tooth rings 37 and second pole tooth rings 38, improving production efficiency as well as molding accuracy.

Figure 10:
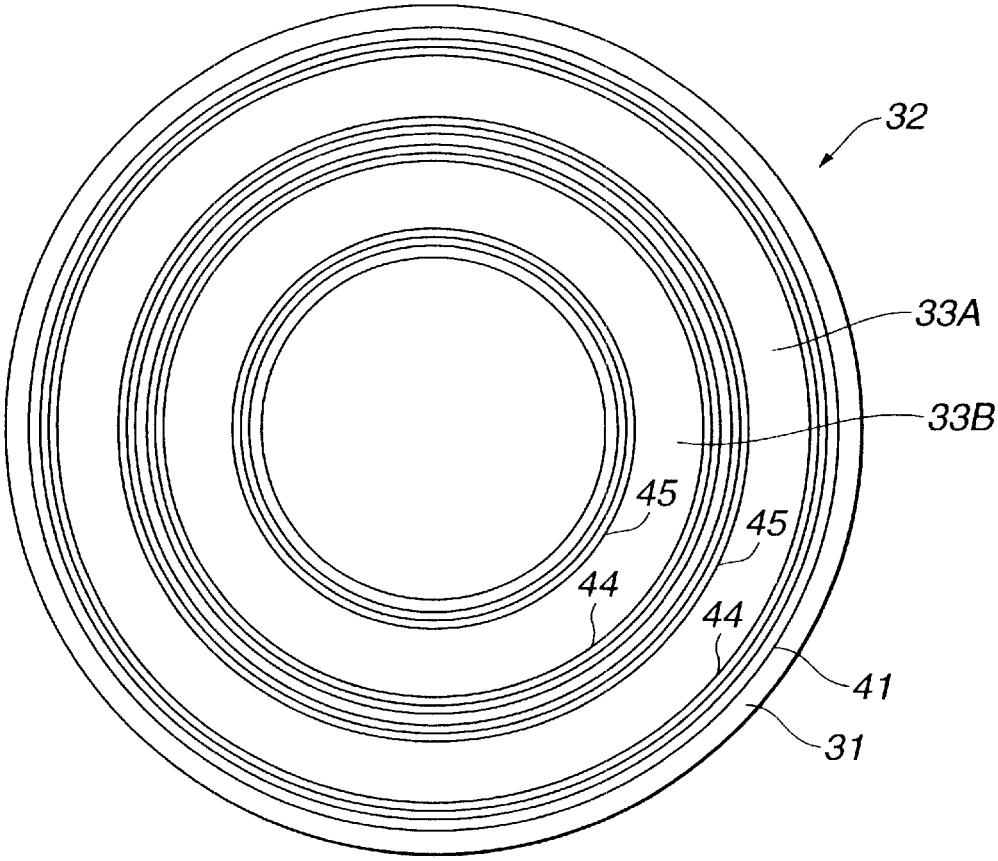
FIG. 10 is a view of an end face of taken along the lines X—X in FIG. 1, according to the first embodiment.
Figure 11:
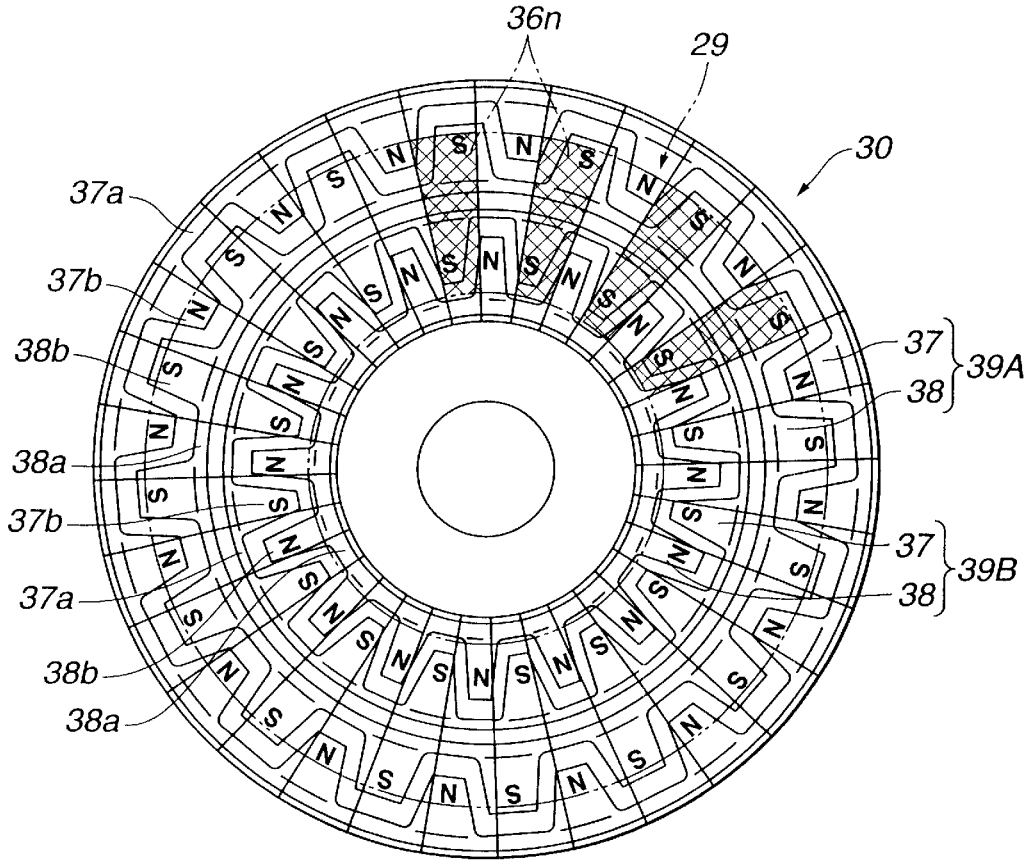
FIG. 11 shows a schematic side view of a yoke block 30 which is overlapped with imaginary lines of a plurality of north-pole magnetic surfaces 36*n* of a permanent magnet block 29, according to the first embodiment.

On the other hand, as is seen in FIGS. 1 and 10, electromagnetic coil block 32 has two-phase electromagnetic coil, that is, first electromagnetic coil 33A and second electromagnetic coil 33B which are radially arranged, respectively, outward and inward. Electromagnetic coil block 32 is received in a housing 41 which is fixed in valve timing control cover 31 and has an opening on a side of yoke block 30.

Each of first electromagnetic coil 33A and second electromagnetic coil 33B is constituted of a coil body 43 and a coil yoke 46. Coil body 43 winds around an annular bobbin 42. Coil yoke 46 is disposed around coil body 43, and induces magnetic flux (caused to coil body 43) to a first magnetic input-output end 44 and a second magnetic input-output end 45 which are disposed on a side facing yoke block 30. As is seen in the enlarged part of FIG. 1, first magnetic input-output end 44 of each of first electromagnetic coil 33A and second electromagnetic coil 33B faces, via an axial air gap AG, first base section 37*a* of first pole tooth ring 37 of yoke block 30, while second magnetic input-output end 45 of each of first electromagnetic coil 33A and second electromagnetic coil 33B faces, via air gap AG, second base section 38*a* of second pole tooth ring 38 of yoke block 30.

Magnetizing first electromagnetic coil 33A and second electromagnetic coil 33B will generate a magnetic field in a predetermined direction, to thereby cause a magnetic induction (corresponding to the thus generated magnetic field) to first yoke 39A (facing first electromagnetic coil 33A via air gap AG) and second yoke 39B (facing second electromagnetic coil 33B via air gap AG). Hereinabove, whether or not the magnetic induction is caused is not influenced by the rotation of yoke block 30. As a result, first pole tooth ring 37 and second pole tooth ring 38 of each of first yoke 39A and of second yoke 39B will have magnetic pole corresponding to the direction of the magnetic field.

The magnetic field generated by first electromagnetic coil 33A and second electromagnetic coil 33B can be switched sequentially in accordance with a predetermined pattern corresponding to pulse inputted from drive circuit 34. More specifically, the switching pattern of the magnetic field of first electromagnetic coil 33A and second electromagnetic coil 33B can be shown, for example, by the excitation sequence, as is seen in FIG. 12.

In FIG. 12, a downward arrow ↓ indicates the magnetic field which is generated by first electromagnetic coil 33A and second electromagnetic coil 33B with first pole tooth ring 37 (of yoke block 30) featuring N-pole and second pole tooth ring 38 (of yoke block 30) featuring S-pole. Contrary to the above, an upward arrow ↑ indicates the magnetic field which is generated by first electromagnetic coil 33A and second electromagnetic coil 33B with first pole tooth ring 37 featuring S-pole and second pole tooth ring 38 featuring N-pole.

Moreover, first electromagnetic coil 33A and second electromagnetic coil 33B in FIG. 12 are wound in a form of a monofiler. "FORWARD" of "EXCITATION" indicates excitation current direction corresponding to downward arrow ↓, while "REVERSE" of "EXCITATION" indicates excitation current direction corresponding to upward arrow ↑.

Hereinafter described step by step are the switching patterns in FIG. 12:

At step 1, allowing first electromagnetic coil 33A to feature the excitation current "FORWARD" will generate the magnetic field indicated by downward arrow ↓, and second electromagnetic coil 33B to feature the excitation current "FORWARD" will generate the magnetic field indicated by downward arrow ↓. Thus, first pole tooth ring 37 of each of first yoke 39A and second yoke 39B may feature N-pole, while second pole tooth ring 38 of each of first yoke 39A and second yoke 39B may feature S-pole. With repulsion against first pole teeth 37*b* (N-pole) and attraction toward second pole teeth 38*b* (S-pole), north-pole magnetic surface 36*n* (N-pole) of permanent magnet block 29 (which was originally placed in a position indicated by two-dot chain line in FIG. 12) may be shifted by ¼ pitches in one direction (leftward in FIG. 12), so as to face second pole tooth 38*b* (S-pole) of first yoke 39A and second pole tooth 38*b* (S-pole) of second yoke 39B in a striding manner.

Likewise at step 2, the excitation currents of first electromagnetic coil 33A and second electromagnetic coil 33B are respectively "REVERSE" and "FORWARD," to thereby generate the magnetic fields indicated respectively by upward arrow ↑ and downward arrow ↓.

Likewise at step 3, the excitation currents of first electromagnetic coil 33A and second electromagnetic coil 33B are respectively "REVERSE" and "REVERSE," to thereby generate the magnetic fields indicated respectively by upward arrow ↑ and upward arrow ↑.

Likewise at step 4, the excitation currents of first electromagnetic coil 33A and second electromagnetic coil 33B are respectively "FORWARD" and "REVERSE," to thereby generate the magnetic fields indicated respectively by downward arrow ↓ and upward arrow ↑.

From step 1 to step 4, first pole teeth 37*b* and/or second pole teeth 38*b* featuring S-pole may be shifted by ¼ pitches in the one direction (leftward in FIG. 12). Thus, permanent magnet block 29 may rotate in such a manner that north-pole magnetic surface 36*n* follows the shift of the S-pole of first pole teeth 37*b* and/or second pole teeth 38*b*.

Thereby, repetition of the switching patterns of the generated magnetic field can continue revolution (in the one direction) of permanent magnet block 29 relative to yoke block 30. Backward repetition of the switching pattern of the generated field can continue revolution (in opposite direction) of permanent magnet block 29 relative to yoke block 30. Moreover, stopping the switching patterns of the generated magnetic field in electromagnetic coil block 32 may stop the revolution of permanent magnet block 29 relative to yoke block 30. The thus stop position can be securely maintained by dint of the magnetic attraction-repulsion which continues to act between first and second pole teeth 37*b*, 38*b* (of yoke block 30) and north and south-pole magnetic surfaces 36*n*, 36*s* (of permanent magnet block 29).

With rotary force generator 4 having the constitution described above, permanent magnet block 29 can freely revolve relative to yoke block 30 by dint of a force generated at electromagnetic coil block 32 (irrotational). Moreover, rotary force generator 4 can securely maintain the relative revolution position.

In addition, energizing rotary force generator 4 does not require slip ring and the like. Therefore, rotary force generator 4 has a good durability for long time operation.

Moreover, electromagnetic coil block 32 generating the magnetic field does not rotate integrally with the power transmission system of the rotary phase controller (valve timing controller), thereby reducing inertia force of the rotary section of the rotary phase controller. With this, the rotary phase controller (valve timing controller) can be reduced in load applied thereto, and improved in operational responsiveness.

The method of winding first electromagnetic coil 33A and second electromagnetic coil 33B is not limited to the monofiler. Other method is allowed such as bifiler. The bifiler method can simplify the excitation circuit in drive circuit 34 as compared with the monofiler method, to thereby further reduce the production cost.

In the valve timing controller described above, permanent magnet block 29 (middle rotor 23) can freely revolve relative to yoke block 30 according to an instruction from controller 35, whether or not yoke block 30 (cam shaft 1) is rotating or not. In addition, the valve timing controller can continue securing position of the relative revolution, to thereby freely vary rotary phase of the crank shaft (not shown) relative to cam shaft 1.

Namely, securing in advance an angle of mounting drive plate 3 and lever shaft 10 on a most lagging angle side as is seen in FIG. 5 during idling or starting of the internal combustion engine can maintain the rotary phase (opening-closing timing of the internal combustion engine) of the crank shaft (not shown) relative to cam shaft 1 on the most lagging angle side, to thereby stabilize rotation of the internal combustion engine and reduce fuel consumption.

Then, for example, as the internal combustion engine shifts from the above state to the normal operating state in which the instruction is carried out from controller 35 to drive circuit 34 (of first electromagnetic coil 33A and second electromagnetic coil 33B) for varying the rotary phase to the most leading angle side, electromagnetic coil block 32 can switch the generated magnetic field at the predetermined pattern in accordance with the instruction. Thereby, electromagnetic coil block 32 can rotate permanent magnet block 29 and middle rotor 23 to the most leading angle. Thereby, movable member 17 (second ball 20) is guided along spiral slot 24 of middle rotor 23, and thereby is shifted most outside radially, as is seen in FIG. 4. With this, the angle of mounting drive plate 3 and lever shaft 10 can be shifted to the most leading angle side by way of link 14 and lever 9. As a result, rotary phase between the crank shaft (not shown) and cam shaft 1 can be shifted to the most leading angle, to thereby increase the output of the internal combustion engine.

In the case of the valve timing controller described above, continuation of the excitation of each of first electromagnetic coil 33A and second electromagnetic coil 33B is allowed after the rotary phase shift as described above. Excitation of the electromagnetic coil 33A and second electromagnetic coil 33B is, however, stopped after the rotary phase shift. Even after the excitation stop of first electromagnetic coil 33A and second electromagnetic coil 33B, the magnetic force of permanent magnet block 29 can attract first pole tooth ring 37 and second pole tooth ring 38. Thus, the rotary phase described above can be securely maintained by dint of the magnetic force of permanent magnet block 29.

Moreover, during the phase shift described above, torque amplifier 5 can amplify the rotary operating force obtained by switching the generated magnetic fields. Thus, the magnetic force generated at first electromagnetic coil 33A and second electromagnetic coil 33B can be comparatively small.

In addition, controlling the stop position of permanent magnet block 29 relative to yoke block 30 can freely vary the rotary phase between the crank shaft (not shown) and cam shaft 1, whether or not the rotary phase is at the most lagging angle or the most leading angle.

According to the first embodiment, torque amplifier 5 has such a constitution that movable member 17 can be engageably guided by inner walls of radial slot 8 and spiral slot 24 which intersect continuously with the direction of lever 9 and intersect substantially orthogonally with each other. Thus, even when a disturbance such as reversed torque which may be caused by the force of the valve spring and/or profile of the drive cam is inputted to movable member 17 by way of lever 9 and link 14, the inner walls of radial slot 8 and spiral slot 24 can securely absorb load of the disturbance. As a result, rotary phase variation attributable to the input of the disturbance of the reversed torque can be prevented, and decrease in operation response during phase variation can be prevented.

Moreover, according to the first embodiment, movable member 17 constituting torque amplifier 5 is so guided and engaged as to roll relative to radial slot 8 and spiral slot 24 by way of respective first ball 18 and second ball 20. The rolling of movable member 17 can decrease operation resistance to a great extent during phase shift, to thereby decrease power consumption of first electromagnetic coil 33A and second electromagnetic coil 33B.

Each of first electromagnetic coil 33A and second electromagnetic coil 33B of electromagnetic coil block 32 has a minimum width. According to the first embodiment, however, electromagnetic coil block 32 is disposed on a first axial side (left in FIG. 1) of yoke block 30 while permanent magnet block 29 is disposed on a second side (opposite to the first axial side) of yoke block 30, in addition, first electromagnetic coil 33A and second electromagnetic coil 33B can be radially disposed in electromagnetic block 32. With the dispositions described above, rotary force generator 4 can be shortened axially, to thereby reduce overall size of the rotary phase controller (valve timing controller).

As is seen in FIGS. 13A and 13B (also referred to coolectively as FIG. 13), there is provided a rotary phase controller (valve timing controller), according to a second embodiment of the present invention.

The rotary phase controller according to the second embodiment has a constitution that is different in coil yoke from the first embodiment. More specifically, a coil yoke 146 according to the second embodiment is different from coil yoke 46 according to the first embodiment. Other parts and sections according to the second embodiment are substantially the same as those according to the first embodiment.

Each of first electromagnetic coil 33A and second magnetic coil 33B according to the second embodiment is equipped with coil yoke 146 that induces the magnetic flux (generated at coil body 43) to yoke block 30. Coil yoke 146 is constituted of a main yoke 60 (coil yoke body) and a pair of sub-yokes 61. Main yoke 60 has a half cross section shaped substantially into an alphabetical U, and surrounds substantially entire periphery of coil body 43. The pair of sub-yokes 61 are press fitted to respective open ends of the alphabetical U of main yoke 60.

Hereinabove, "half cross section" means FIG. 13 shows only upper part of main yoke 60, leaving lower part of main yoke 60 not shown. This definition of "half cross section" also applies to descriptions hereinafter.

Sub-yoke 61 is annular, and has a half cross section shaped substantially into an alphabetical L as is seen in an enlarged part of FIG. 13. The alphabetical L of sub-yoke 61 has a first side (horizontal in FIG. 13) constituted of a cylindrical wall 61*a* and a second side (vertical in FIG. 1) constituted of a bent piece 61*b*. Bent piece 61*b* is monolithic with a first end (right in FIG. 13) of cylindrical wall 61*a* in such a manner as to form a flange. Sub-yoke 61 is thinner than main yoke 60. Cylindrical wall 61*a* is press fitted into an annular cutout 60*a* of main yoke 60. Thus, according to the second embodiment, an end face (of main yoke 60) and the bent 61*b* (of sub-yoke 61) constitute a magnetic input-output end (of coil yoke 146) which opposes each of first pole tooth ring 37 and second pole tooth ring 38 of yoke block 30. In FIG. 13, there is defined a thickness T1 of main yoke 60, and a thickness T2 of sub-yoke 61.

An inner peripheral wall of main yoke 60 is thicker than an outer peripheral wall of main yoke 60, to thereby minimize difference in cross section between the inner peripheral wall and the outer peripheral wall. Thus, the overall magnetic resistance can be maintained small from the inner peripheral wall to the outer peripheral wall of main yoke 60.

According to the second embodiment, the magnetic input-output end of coil yoke 146 is constituted of the end face (of main yoke 60) and bent piece 61*b* (of sub-yoke 61). Thus, the area (of the magnetic input-output end) opposing first pole tooth ring 37 and second pole tooth ring 38 can be formed larger than the cross section of main yoke 60. Thereby, decreasing the magnetic resistance at air gap AG does not involve enlargement of main yoke 60.

Being a part of sub-yoke 61 which is not monolithic with main yoke 60, bent piece 61*b* can be formed sufficiently thinner than main yoke 60. Thus, bending bent piece 61*b* of sub-yoke 61 during molding is of ease, and overall axial length of coil yoke 146 can be reduced. Moreover, main yoke 60 can be formed sufficiently thick (great in cross section) irrespective of thickness of bent piece 61*b*. Thereby, the magnetic resistance of main yoke 60 can be sufficiently small.

Moreover, according to the second embodiment, due to the following constitutions sub-yoke 61 can be securely fixed to main yoke 60 whether or not the entire thickness of sub-yoke 61 is reduced:

1. Annular sub-yoke 61 is so formed as to have the half cross section shaped substantially into the alphabetical L.
2. Cylindrical wall 61*a* constituting the first side (horizontal in FIG. 13) of the alphabetical L is press fitted into main yoke 60.

Bent piece 61*b* disposed radially outside (extending radially inward in FIG. 13) has a first area opposing first pole tooth ring 37, while bent piece 61*b* disposed radially inside (extending radially outward in FIG. 13) has a second area opposing second pole tooth ring 38. Bent piece 61*b* disposed radially inside is preferred longer than bent piece 61*b* disposed radially outside, for the following cause:

In this case, difference between the first area and the second area described above can be decreased. Thus, the magnetic resistance of the entire part including air gap AG can be further reduced.

According to the second embodiment described above, the coil yoke body (main yoke 60) of coil yoke 146 is not monolithic with bent piece 61*b* of sub-yoke 61, for ease of production. The second embodiment is, however, not limited to the one described above. The coil yoke body (main yoke 60) of coil yoke 146 can be monolithic with bent piece 61*b* of sub-yoke 61.

As is seen in FIGS. 14 and 15, there is provided a rotary phase controller (valve timing controller), according to a third embodiment of the present invention.

Like the first embodiment, the rotary phase controller according to the third embodiment is applied to the valve timing controller of the internal combustion engine. The valve timing controller according to the third embodiment, however, has a constitution that is different in rotary force generator. More specifically, a rotary force generator 104 according to the third embodiment is different from rotary force generator 4 according to the first embodiment. Other parts and sections according to the third embodiment are substantially the same as those according to the first embodiment. Therefore, described hereinafter are the differences only from the first embodiment. Parts and sections common to those of the first embodiment are denoted by the same numerals, and repeated descriptions are to be omitted.

Like rotary force generator 4 according to the first embodiment, rotary force generator 104 according to the third embodiment is constituted of a permanent magnet block 129, a yoke block 130 and an electromagnetic coil block 132 which are a little different in constitution, respectively, from permanent magnet block 29, yoke block 30 and electromagnetic coil block 32 according to the first embodiment.

As is seen in FIG. 15, permanent magnet block 129 has an overall constitution which is shaped substantially into a cylinder. A plurality of magnetic poles extending axially are disposed in such a manner that different magnetic poles alternate circumferentially. More specifically in FIG. 15, there are shown a plurality of north-pole magnetic surfaces 136*n* and a plurality of south-pole magnetic surfaces 136*s*.

Yoke block 130 is constituted of a first yoke 139A and a second yoke 139B each of which has a pair of a first pole tooth ring 137 and a second pole tooth ring 138. The entire part of yoke block 130 is shaped substantially into a cylinder having a thin wall. First pole tooth ring 137 and second pole tooth ring 138 of each of first yoke 139A and second yoke 139B are made of metal having high permeability. Moreover, first pole tooth ring 137 has a first base section 137*a* shaped substantially into a cylindrical ring, and a plurality of first pole teeth 137*b* shaped substantially into trapezium and extending axially from first base section 137*a*; while second pole tooth ring 138 has a second base section 138*a* shaped substantially into a cylindrical ring, and a plurality of second pole teeth 138*b* shaped substantially into trapezium and extending axially from second base section 138*a*. First pole tooth ring 137 and second pole tooth ring 138 are arranged axially in such a manner that first pole teeth 137*b* and second pole teeth 138*b* can be disposed circumferentially at regular angular intervals. Moreover, addenda of first pole teeth 137*b* and second pole teeth 138*b* extend axially in such a manner as to direct, respectively, toward second base section 138*a* (of the mating second pole tooth ring 138) and first base section 137*a* (of the mating first pole tooth ring 137).

First yoke 139A and second yoke 139B are arranged axially. Resin material 40 (insulator) is filled between first pole tooth ring 137 and second pole tooth ring 138 so as to fill all gaps between first pole tooth ring 137 and second pole tooth ring 138. First base section 137*a* and second base section 138*a* are disposed radially outside, while first pole teeth 137*b* and second pole teeth 138*b* are disposed radially inside. For allowing disposition described above, a connection is bent between first pole tooth 137*b* and first base section 137*a*, while a connection is bent between second pole tooth 138*b* and second base section 138*a*. Yoke block 130 is spaced apart from permanent magnet block 129, and disposed radially outside permanent magnet block 129. Each of first pole tooth 137*b* and second pole tooth 138*b* is so disposed as to face north-pole magnetic surface 136*n* and south-pole magnetic surface 136*s* of permanent magnet block 129.

On the other hand, electromagnetic coil block 132 has an annular housing 141 which is open radially inward and fixed to an inner periphery of valve timing control cover 31. A first electromagnetic coil 133A and a second electromagnetic coil 133B are arranged axially in housing 141. Moreover, each of first electromagnetic coil 133A and second electromagnetic coil 133B has a first magnetic input-output end 144 and a second magnetic input-output end 145 which are so arranged to direct radially inward. Yoke block 130 is disposed radially inside electromagnetic coil block 132, in such a manner that first base section 137*a* (of first pole tooth ring 137 of each of first yoke 139A and second yoke 139B) and second base section 138*a* (of second pole tooth ring 138 of each of first yoke 139A and second yoke 139B) face, respectively, first magnetic input-output end 144 and second magnetic input-output end 145 by way of air gap AG.

According to the first embodiment, permanent magnet block 29 is fixed to middle rotor 23, while yoke block 30 is fixed to hold ring 12 which is coupled to cam shaft 1.

Contrary to the above, in the valve timing controller according to the third embodiment, permanent magnet block 129 is fixed to drive plate 3 by way of a first bracket 50, while yoke block 130 is fixed to a middle rotor 123 by way of a second bracket 51. According to the third embodiment, a rotary operating force generated at rotary force generator 104 can be inputted to torque amplifier 5 by way of middle rotor 123, and an amplified force (which is amplified with torque amplifier 5) can be sent to drive plate 3 and cam shaft 1; although permanent magnet block 129 and yoke block 130 according to the third embodiment are fixed to members different from those of their counterparts (namely, permanent magnet block 29 and yoke block 30) according to the first embodiment. According to the third embodiment, a radial ball bearing 52 can support middle rotor 123 to a lever shaft 110 which is monolithic with a hold ring.

Rotary force generator 104 of the valve timing controller according to the third embodiment has fundamental functions substantially the same as those of rotary force generator 4 according to the first embodiment. Thus, according to the third embodiment, switching at predetermined patterns the magnetic field which is generated at electromagnetic coil block 132 can vary freely the rotary phase of the crank shaft (not shown) relative to cam shaft 1, like the first embodiment. Moreover, like the first embodiment, radial slot 8, spiral slot 24, movable member 17, link 14 and the like of torque amplifier 5 are so constituted as to receive the disturbance which may be caused by the reversed torque and the like.

The valve timing controller according to the third embodiment is, however, so constituted that permanent magnet block 129 is disposed radially inside yoke block 130 while electromagnetic coil block 132 is disposed radially outside yoke block 130. The above constitution can maintain preferable torque balance when yoke block 130 and permanent magnet block 129 make revolution relative to each other.

More specifically, the relative revolution between yoke block 130 and permanent magnet block 129 can sequentially vary the magnetic pole of first pole teeth 137*b* and the magnetic pole of second pole teeth 138*b*, to thereby shift circumferentially magnetic attraction section and magnetic repulsion section between permanent magnet block 129 and yoke block 130. Hereinabove, the magnetic attraction and repulsion sections (namely, first pole teeth 137*b*, second pole teeth 138*b*, north-pole magnetic surface 136*n* and south-pole magnetic surface 136*s*) are all equidistant from a rotary center. Thus, variation in drive torque which may be caused by step motions can be extremely small, to thereby smoothen rotary operation of the rotary phase controller.

Although the present invention has been described above by reference to three embodiments, the present invention is not limited to the three embodiments described above. Modifications and variations of the three embodiments described above will occur to those skilled in the art, in light of the above teachings.

More specifically, not only to the valve timing controller of the internal combustion engine, the phase controller can be applied to other power transmission systems.

The entire contents of basic Japanese Patent Application No. P2001-184301 (filed on Jun. 19, 2001 in Japan) of which priority is claimed and basic Japanese Patent Application No. P2001-323941 (filed on Oct. 22, 2001 in Japan) are incorporated herein by reference.

The scope of the present invention is defined with reference to the following claims.

What is claimed is:

1. A rotary phase controller varying rotary phase of a drive rotor and a follower rotor through a relative rotary operation between the drive rotor which is rotatably driven and the follower rotor which receives a power from the drive rotor, the rotary phase controller comprising:

a permanent magnet block disposed on one of the drive rotor's side and the follower rotor's side, the permanent magnet block having a constitution in which different magnetic pole surfaces of a permanent magnet are alternately arranged circumferentially;

a yoke block disposed as a whole on the other of the drive rotor's side and the follower rotor's side, the yoke block including a plurality of yokes including a first yoke and a second yoke, each of the plurality of the yokes including:

a first pole tooth ring formed with a plurality of first pole teeth which oppose the magnetic pole surfaces of the permanent magnet block, and a second pole tooth ring formed with a plurality of second pole teeth which oppose the magnetic pole surfaces of the permanent magnet block, the first pole teeth and the second pole teeth being alternately disposed circumferentially, the first yoke and the second yoke being assembled such that the first pole teeth of the first yoke are shifted by a predetermined pitch circumferentially from the second pole teeth of the second yoke;

an electromagnetic coil block fixed to an irrotational member, the electromagnetic coil block including a plurality of electromagnetic coils including a first electromagnetic coil and a second electromagnetic coil corresponding respectively to the first yoke and the second yoke of the yoke block, each of the first electromagnetic coil and the second electromagnetic coil having a magnetic input-output end opposing, by way of an air gap, the first pole tooth ring and the second pole tooth ring of the respective first yoke and second yoke, the yoke block and the permanent magnet block making a revolution relative to each other by varying at a predetermined pattern a magnetic field which is generated at the plurality of the electromagnetic coils.

2. The rotary phase controller as claimed in claim 1, wherein at least one of the yoke block and the permanent magnet block is connected to one of the drive rotor and the follower rotor by way of a torque amplifier.

3. The rotary phase controller as claimed in claim 2, wherein the torque amplifier comprises:

a radial guide disposed on one of the drive rotor's side and the follower rotor's side, a movable member engageably supported to the radial guide in such a manner as to displace radially, the movable member connecting by way of a link to a portion which is spaced apart at a predetermined distance from a rotary center of the other of the drive rotor and the follower rotor, a middle rotor having a spiral guide which engageably guides the movable member, the middle rotor being disposed in such a manner as to revolve relative to the drive rotor and the follower rotor, and the middle rotor is rotatably integrated with one of the yoke block and the permanent magnet block.

4. The rotary phase controller as claimed in claim 3, wherein at least one of a first pair of the movable member and the spiral guide and a second pair of the movable member and the radial guide are rollably engaged by way of a ball.

5. The rotary phase controller as claimed in claim 1, wherein an insulator is filled between the adjacent yokes of the yoke block, and between the first pole tooth ring and the second pole tooth ring of each of the yokes.

6. The rotary phase controller as claimed in claim 5, wherein the first pole tooth ring has a first base section shaped substantially into a ring, and the second pole tooth ring has a second base section shaped substantially into a ring, and the first pole tooth ring and the second pole tooth ring are so bent that the respective first base section and second base section are disposed on the electromagnetic coil block's side while the respective first pole teeth and second pole teeth are disposed on the permanent magnet block's side.

7. The rotary phase controller as claimed in claim 1, wherein each of the first electromagnetic coil and the second electromagnetic coil of the electromagnetic coil block includes a coil yoke, the coil yoke surrounds a coil body, and has a cross section shaped substantially into an alphabetical U and having an opening toward the yoke block's side, the opening of the coil yoke has an end which is formed with a bent piece, the bent piece extends in such a manner as to oppose at least one of the first pole tooth ring and the second pole tooth ring of the yoke block, and constitutes the magnetic input-output end, and the bent piece has a thickness which is smaller than a thickness of a coil yoke body.

8. The rotary phase controller as claimed in claim 7, wherein the coil yoke includes:

a main yoke constituting the coil yoke body having a cross section shaped substantially into the alphabetical U, and a sub-yoke having the bent piece, and mounted to an open end of the main yoke.

9. The rotary phase controller as claimed in claim 8, wherein the sub-yoke is shaped substantially into an annular ring having a cross section shaped substantially into an alphabetical L.

10. The rotary phase controller as claimed in claim 7, wherein the coil yoke body has an outer peripheral wall and an inner peripheral wall which is thicker than the outer peripheral wall.

11. The rotary phase controller as claimed in claim 7, wherein the bent piece disposed radially inside extends longer than the bent piece disposed radially outside.

12. The rotary phase controller as claimed in claim 1, wherein the permanent magnet block has a surface which is substantially orthogonal to a direction of axis of the rotary phase controller and which is circumferentially formed with a plurality of the magnetic pole surfaces extending radially, the yoke block is so constituted that the pole tooth rings of all the yokes are arranged radially in a form of a disk, and that the first pole teeth of the first pole tooth ring of each of the yokes extend radially to direct toward the corresponding second base section while the second pole teeth of the second pole tooth ring of each of the yokes extend radially to direct toward the corresponding first base section, and the electromagnetic coil block is so constituted that the first electromagnetic coil and the second electromagnetic coil are arranged radially to oppose the corresponding respective first yoke and second yoke of the yoke block by way of the air gap which is formed axially.

13. The rotary phase controller as claimed in claim 1, wherein the permanent magnet block has a surface which is substantially cylindrical and which is circumferentially formed with a plurality of the magnetic pole surfaces extending in a direction of axis of the rotary phase controller, the yoke block is so constituted that the pole tooth rings of all the yokes are arranged axially in a form of a cylinder, and that the first pole teeth of the first pole tooth ring of each of the yokes extend axially to direct toward the corresponding second base section while the second pole teeth of the second pole tooth ring of each of the yokes extend axially to direct toward the corresponding first base section, and the electromagnetic coil block is so constituted that the first electromagnetic coil and the second electromagnetic coil are arranged axially to oppose the corresponding respective first yoke and second yoke of the yoke block by way of the air gap which is formed radially.

14. The rotary phase controller as claimed in claim 1, wherein the drive rotor connects to a crank shaft of an internal combustion engine, the follower rotor connects to a cam shaft of the internal combustion engine, and the drive rotor and the follower rotor are so varied in rotary phase as to vary valve's open-close timing of the internal combustion engine.

15. A valve timing controller of an internal combustion engine varying rotary phase of a crank shaft and a cam shaft through a relative rotary operation between a drive rotor which is driven by the crank shaft and a follower rotor which is one of the cam shaft and a member coupled to the cam shaft, the valve timing controller comprising:

a permanent magnet block disposed on one of the drive rotor's side and the follower rotor's side, the permanent magnet block having a constitution in which different magnetic pole surfaces of a permanent magnet are alternately arranged circumferentially;

a yoke block disposed as a whole on the other of the drive rotor's side and the follower rotor's side, the yoke block including a plurality of yokes including a first yoke and a second yoke, each of the plurality of the yokes including:

a first pole tooth ring formed with a plurality of first pole teeth which oppose the magnetic pole surfaces of the permanent magnet block, and a second pole tooth ring formed with a plurality of second pole teeth which oppose the magnetic pole surfaces of the permanent magnet block, the first pole teeth and the second pole teeth being alternately disposed circumferentially, the first yoke and the second yoke being assembled such that the first pole teeth of the first yoke are shifted by a predetermined pitch circumferentially from the second pole teeth of the second yoke;

an electromagnetic coil block fixed to an irrotational member, the electromagnetic coil block including a plurality of electromagnetic coils including a first electromagnetic coil and a second electromagnetic coil corresponding respectively to the first yoke and the second yoke of the yoke block, each of the first electromagnetic coil and the second electromagnetic coil having a magnetic input-output end opposing, by way of an air gap, the first pole tooth ring and the second pole tooth ring of the respective first yoke and second yoke, the yoke block and the permanent magnet block making a revolution relative to each other by varying at a predetermined pattern a magnetic field which is generated at the plurality of the electromagnetic coils.

* * * * *